US010036255B2

(12) United States Patent
Szijarto et al.

(10) Patent No.: US 10,036,255 B2
(45) Date of Patent: Jul. 31, 2018

(54) TECHNIQUE FOR COOLING A ROOT SIDE OF A PLATFORM OF A TURBOMACHINE PART

(71) Applicant: Siemens Aktiengesellschaft, Munich (DE)

(72) Inventors: Janos Szijarto, Finspong (SE); Lieke Wang, Svartinge (SE)

(73) Assignee: Siemens Aktiengesellschaft, Munich (DE)

( * ) Notice: Subject to any disclaimer, the term of this patent is extended or adjusted under 35 U.S.C. 154(b) by 281 days.

(21) Appl. No.: 14/773,347

(22) PCT Filed: Mar. 18, 2014

(86) PCT No.: PCT/EP2014/055420

§ 371 (c)(1),
(2) Date: Sep. 6, 2015

(87) PCT Pub. No.: WO2014/161716

PCT Pub. Date: Oct. 9, 2014

(65) Prior Publication Data

US 2016/0017714 A1 Jan. 21, 2016

(30) Foreign Application Priority Data

Apr. 4, 2013 (EP) ..... 13162346

(51) Int. Cl.

| | |
|---|---|
| ***F01D 25/08*** | (2006.01) |
| ***F01D 5/08*** | (2006.01) |
| ***F01D 5/18*** | (2006.01) |
| ***F01D 9/02*** | (2006.01) |

(52) U.S. Cl.

CPC ..... *F01D 5/081* (2013.01); *F01D 5/187* (2013.01); *F01D 9/023* (2013.01);
(Continued)

(58) Field of Classification Search

CPC ..... F01D 5/081; F01D 5/187; F01D 9/023; F05D 2240/81; F05D 2260/201; F05D 2260/205
(Continued)

(56) References Cited

U.S. PATENT DOCUMENTS

| | | | |
|---|---|---|---|
| 3,950,113 | A | 4/1976 | Albrecht |
| 5,122,033 | A | 6/1992 | Paul |

(Continued)

FOREIGN PATENT DOCUMENTS

| | | | |
|---|---|---|---|
| EP | 1621726 | A2 | 2/2006 |
| RU | 2355890 | C1 | 5/2009 |
| RU | 2532791 | C1 | 11/2014 |

OTHER PUBLICATIONS

CN Office Action, dated May 11, 2016, for CN application No. 201480017316.X.

(Continued)

*Primary Examiner* — Laert Dounis
*Assistant Examiner* — Kelsey Stanek
(74) *Attorney, Agent, or Firm* — Beusse Wolter Sanks & Maire

(57) ABSTRACT

A platform cooling device directs a cooling fluid onto a root side of a platform of a turbomachine part. The platform cooling device includes a first segment to be positioned at a root of the turbomachine part and a second segment, at an angle to the first segment, to be positioned at the root side of the platform of the turbomachine part. The second segment may include at least one impingement channel having an inlet for receiving at least a part of the cooling fluid and an outlet for releasing the received cooling fluid onto the root side of the platform. The first segment and the second
(Continued)

segment may define a path for the cooling fluid via the impingement channel. A turbomachine component includes the platform cooling device.

13 Claims, 7 Drawing Sheets

(52) U.S. Cl.
CPC .... *F05D 2240/81* (2013.01); *F05D 2260/201* (2013.01); *F05D 2260/205* (2013.01)

(58) Field of Classification Search
USPC ..... 415/177
See application file for complete search history.

(56) References Cited

U.S. PATENT DOCUMENTS

| | | | | |
|---|---|---|---|---|
| 2008/0166240 | A1 | 7/2008 | Scott et al. | |
| 2009/0016881 | A1* | 1/2009 | Baldauf | F01D 5/22 416/95 |
| 2009/0060712 | A1* | 3/2009 | De Cardenas | F01D 5/081 415/115 |
| 2014/0144551 | A1 | 5/2014 | Minato et al. | |

OTHER PUBLICATIONS

RU Decision to Grant dated Feb. 1, 2018, for RU patent application No. 2015147378.

* cited by examiner

TECHNIQUE FOR COOLING A ROOT SIDE OF A PLATFORM OF A TURBOMACHINE PART

CROSS REFERENCE TO RELATED APPLICATIONS

This application is the US National Stage of International Application No. PCT/EP2014/055420 filed Mar. 18, 2014, and claims the benefit thereof. The International Application claims the benefit of European Application No. EP13162346 filed Apr. 4, 2013. All of the applications are incorporated by reference herein in their entirety.

FIELD OF INVENTION

The present invention relates to a turbomachine part such as a blade or a vane of a turbomachine and more particularly to a platform cooling device for the turbomachine part.

BACKGROUND OF INVENTION

In modern day turbomachines, such as a gas turbine, various parts of the turbomachine operate at very high temperatures. These turbomachine parts, such as a blade or a vane, typically include an airfoil portion and a root portion separated by a platform. The high temperatures during operation of the turbomachine may cause damage to the turbomachine part or its constituents, hence cooling of the turbomachine part is important. Cooling of these parts is generally achieved by passing a cooling fluid that may include air from a compressor of the turbomachine through a core passage way cast into the turbomachince part, for example cooling passage ways formed inside the airfoil of the blade.

Thus, the airfoil portion of the turbomachine part, for example a blade, is cooled by directing a cooling fluid to flow through passages formed in the airfoil portion of the turbomachine part.

However, adequate cooling of the platform of the turbomachine part is difficult since cooling air is generally not utilized in cooling the entire platform. Regions of the platform such as an airfoil side of the platform, i.e. a side of the platform from which the airfoil emerges, are exposed to hot gases originating from the combustors. Normally, cooling of the platform is achieved by providing film cooling on the airfoil side of the platform. However, the cooling of the airfoil side is insufficient to adequately cool other regions of the platform especially a root side of the platform, i.e. a side of the platform from which the root emerges. This insufficiency results in oxidation and cracking in the platform, and subsequently reduction of the life span of the turbomachine part.

From US 2009/016881 A1 an arrangement is known in which improved cooling of a platform region and the transition region from a turbine blade to a platform of a turbine blade is provided, thus ensuring the cooling of the delimitation of a flow channel in a gas turbine. To achieve this, the platform includes a first platform wall that does not support the vane and a second platform wall that supports the vane with a hollow space in between. At the root of the vane and over the course of the transition region from the turbine blade to the platform, the first platform wall is aerodynamically curved and the course of the second platform wall has a receding shoulder in relation to the first platform wall, as a continuation of the vane.

SUMMARY OF INVENTION

It is an object of the present invention to provide a technique for cooling a root side of a platform of a turbomachine part.

An object of the invention is achieved by providing a platform cooling device and a turbomachine component according to the claims.

According to an aspect of the present technique, a platform cooling device for directing a cooling fluid onto a root side of a platform of a turbomachine part is presented. The turbomachine part includes an airfoil, the platform, and a root having a main inlet for receiving the cooling fluid from a cavity and directing the cooling fluid into the airfoil. The cavity is at least partially defined by the root of the turbomachine part and the root side of the platform. The platform cooling device is adapted to be fitted in the cavity.

The platform cooling device includes a first segment and a second segment. The first segment is to be positioned at the root of the turbomachine part. The second segment, to be positioned at the root side of the platform, is arranged at an angle to the first segment. The second segment includes at least one impingement channel. The impingement channel includes an inlet for receiving at least a part of the cooling fluid from the cavity and an outlet for releasing the received cooling fluid onto the root side of the platform. The first segment and the second segment define a path for the cooling fluid from the cavity via the impingement channel to the main inlet.

Thus with the help of the platform cooling device, at least a part of the cooling fluid is redirected from the cavity via the impingement channel towards the root side of the platform. The cooling fluid subsequently impinges on the root side of the platform of the turbomachine part thereby cooling the root side of the platform.

In an embodiment of the platform cooling device, the second segment includes at least one rib such that, when the platform cooling device is fitted in the cavity on the root side of the platform, a gap is formed between the root side of the platform and the outlet of the impingement channel. Due to the gap the cooling fluid released from the outlet of the impingement channel spreads onto the root side of the platform of the turbomachine part.

In another embodiment of the platform cooling device, the second segment includes a plurality of ribs such that when the platform cooling device is fitted in the cavity on the root side of the platform, a gap is formed between the root side of the platform and the outlet of the impingement channel. The ribs are oriented substantially parallel to each other. Due to the gap, the cooling fluid released from the outlet of the impingement channel spreads onto the root side of the platform of the turbomachine part. Moreover, the plurality of ribs provides stability to the platform cooling device when it is fitted in the cavity.

In another embodiment of the platform cooling device, the platform cooling device includes a first protrusion at the first segment for attaching to the root of the turbomachine part and a second protrusion at the second segment for attaching to the root side of the platform of the turbomachine part such that a chamber is formed between the platform cooling device and the turbomachine part for directing the cooling fluid from the impingement channel to the main inlet of the root. Thus, the first protrusion and the second protrusion provide stability to the platform cooling device when it is fitted in the cavity of the turbomachine part. Moreover, due to the chamber the cooling fluid released from the outlet of the impingement channel is able to spread onto the root side of the platform and onto a portion of the root of the turbomachine part. Furthermore, the chamber facilitates passage of the cooling fluid from the impingement channel to the main inlet and allows the cooling fluid to exit only through the main inlet.

In another embodiment of the platform cooling device, the second segment includes a plurality of impingement channels. Each of the plurality of impingement channels includes an inlet for receiving at least a part of the cooling fluid from the cavity of the turbomachine part and an outlet for releasing the received cooling fluid onto the root side of the platform of the turbomachine part. The impingement channels are arranged in an array. As a result, a greater area on the root side of the platform is cooled. Moreover, the impingement channels may be positioned in such a way so as to at least substantially concentrate the cooling fluid onto desired positions on the root side of the platform of the turbomachine part.

According to another aspect of the present technique, a turbomachine component is presented. The turbomachine component includes a platform, an airfoil, a root, and a platform cooling device. The platform includes an airfoil side and a root side. The airfoil extends from the airfoil side of the platform and the root extends from the root side of the platform. The airfoil and the root extend from the platform in opposite directions. The root includes a main inlet for receiving a cooling fluid from a cavity on the root side of the platform and directing the cooling fluid into the airfoil. The cavity is at least partially defined by the root of the turbomachine component and the root side of the platform.

The platform cooling device includes a first segment and a second segment. The first segment is positioned at the root of the turbomachine component. The second segment is positioned at the root side of the platform and is arranged at an angle to the first segment. The second segment includes at least one impingement channel. The impingement channel includes an inlet for receiving at least a part of the cooling fluid from the cavity and an outlet for releasing the received cooling fluid onto the root side of the platform. The first segment and the second segment define a path for the cooling fluid from the cavity via the impingement channel to the main inlet. Thus, the cooling of the root side of the platform is achieved.

In an embodiment of the turbomachine component, the second segment includes at least one rib extending towards the root side of the platform such that a gap is formed between the root side of the platform and the outlet of the impingement channel. Due to the gap the cooling fluid released from the outlet of the impingement channel spreads onto the root side of the platform.

In another embodiment of the turbomachine component, the second segment includes a plurality of ribs extending towards the root side of the platform such that a gap is formed between the root side of the platform and the outlet of the impingement channel. The ribs are oriented substantially parallel to each other. Due to the gap, the cooling fluid released from the outlet of the impingement channel spreads onto the root side of the platform. Moreover, the plurality of ribs provides stability to the platform cooling device fitted in the cavity.

In another embodiment of the turbomachine component, a cooling channel is formed by the root side of the platform and a part of the second segment having at least two ribs. The cooling channel directs the cooling fluid towards the main inlet. Thus a direction of flow of the cooling fluid along the root side of the platform may be controlled.

In another embodiment of the turbomachine component, the first segment includes a first protrusion attached to the root of the turbomachine component and the second segment includes a second protrusion attached to the root side of the platform such that a chamber is formed between the platform cooling device, the root side of the platform, and the root of the turbomachine component for directing the cooling fluid from the impingement channel to the main inlet. Thus, the first protrusion and the second protrusion provide stability to the platform cooling device fitted in the cavity. Moreover, due to the chamber, the cooling fluid released from the outlet of the impingement channel spreads onto the root side of the platform and onto a part of the root of the turbomachine. Furthermore, the chamber facilitates passage of the cooling fluid from the impingement channel to the main inlet and allows the cooling fluid to exit only through the main inlet.

In another embodiment of the turbomachine component, the first protrusion is attached to the root of the turbomachine component and the second protrusion is attached to the root side of the platform through brazing. As a result of brazing, a material from which the root or the platform of the turbomachine component is composed of does not melt and this allows tighter control over tolerances, hence producing a clean joint. Furthermore, brazing allows dissimilar metals to be joined. Additionally, brazing produces less thermal distortion due to uniform heating of the brazed piece.

In another embodiment of the turbomachine component, the first protrusion is attached to the root of the turbomachine component and the second protrusion is attached to the root side of the platform through welding. Welding involves a simple and low cost method of attaching the first protrusion to the root and the second protrusion to the root side of the platform.

In another embodiment of the turbomachine component, the second segment includes a plurality of impingement channels. Each of the plurality of impingement channels includes an inlet for receiving at least a part of the cooling fluid from the cavity and an outlet for releasing the received cooling fluid onto the root side of the platform. The impingement channels are arranged in an array. As a result, a greater area on the root side of the platform is cooled. Moreover, the impingement channels may be positioned in such a way so as to at least substantially concentrate the cooling fluid onto desired positions on the root side of the platform.

In another embodiment of the turbomachine component, the turbomachine component is a blade of a turbine. Thus, the cooling of the root side of the platform of the blade may be achieved.

In another embodiment of the turbomachine component, the turbomachine component is a vane of a turbine. Thus, the cooling of the root side of the platform of the vane may be achieved.

Another aspect of the present technique presents, a turbomachine assembly including at least one platform cooling device and at least two turbomachine parts positioned adjacent to each other, wherein each of the turbomachine parts includes a platform having an airfoil side and a root side, an airfoil extending from the airfoil side of the platform, a root extending from the root side of the platform, the root and the airfoil extending in opposite directions, wherein the root includes a main inlet for receiving a cooling fluid from a cavity on the root side of the platform and directing the cooling fluid into the airfoil, the cavity at least partially defined by the root of the turbomachine part and the root side of the platform, and wherein the at least one platform cooling device is fitted in between the two turbomachine parts and in the cavity of one of the turbomachine parts for directing the cooling fluid from the cavity of the one of the turbomachine parts onto the root side of the platform of the one of the turbomachine parts, the platform cooling device including a first segment positioned at the root of the one of the turbomachine parts, a second segment arranged at an angle to the first segment, the second segment positioned at the root side of the platform of the one of the turbomachine parts, wherein the second segment includes at least one impingement channel including an inlet for receiving at least a part of the cooling fluid from the cavity of the one of the turbomachine parts and an outlet for releasing the received cooling fluid onto the root side of the platform of the one of the turbomachine parts, such that the first segment and the second segment define a path for the cooling fluid from the cavity of the one of the turbomachine parts via the impingement channel to the main inlet of the one of the turbomachine parts.

BRIEF DESCRIPTION OF THE DRAWINGS

The present technique is further described hereinafter with reference to illustrated embodiments shown in the accompanying drawings, in which.

DETAILED DESCRIPTION OF INVENTION

Figure 1:
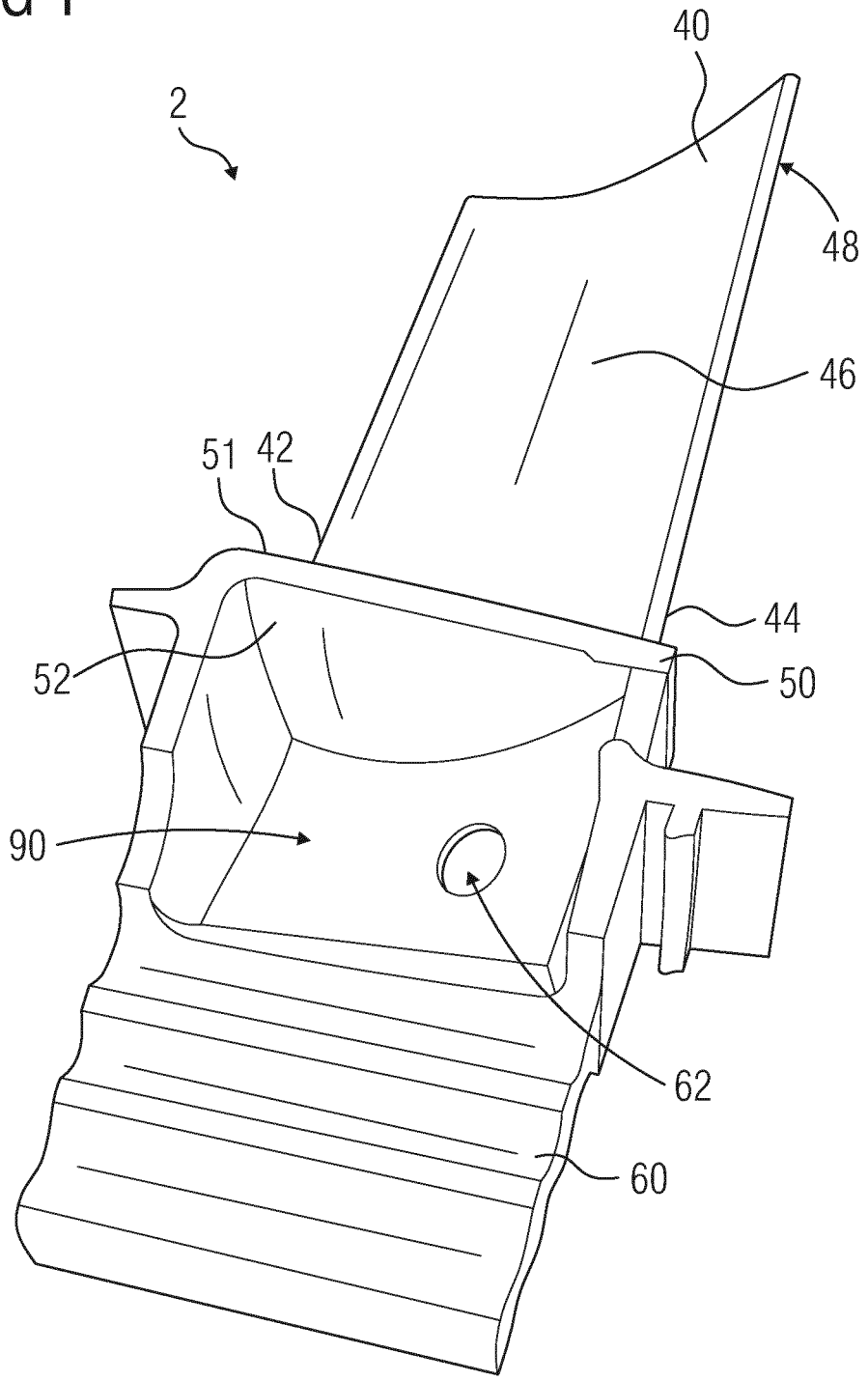
FIG. 1 is a schematic representation of a turbomachine part depicting a root side of a platform and a cavity.

Hereinafter, above-mentioned and other features of the present technique are described in details. Various embodiments are described with reference to the drawings, wherein like reference numerals are used to refer to like elements throughout. In the following description, for purpose of explanation, numerous specific details are set forth in order to provide a thorough understanding of one or more embodiments. It may be noted that the illustrated embodiments are intended to explain, and not to limit the invention. It may be evident that such embodiments may be practiced without these specific details.

A typical turbomachine part is explained in FIG. 1 which schematically representation of a turbomachine part 2 of a turbomachine (not shown). The turbomachine may be a gas turbine, a steam turbine, a turbofan and the like. The turbomachine part 2 may be a blade or a vane or any other turbomachine element having at least an airfoil portion, a platform portion and a root portion.

It may be noted that though in certain embodiments described below the turbomachine part 2 is depicted as a blade of the turbomachine, the details of those embodiments described below for the purposes of the present technique may be transferred to a vane of the turbomachine without modifications.

The turbomachine part 2 includes an airfoil 40, a platform 50 and a root 60. The platform 50 includes an airfoil side 51 and a root side 52. The airfoil 40 extends from the airfoil side 51 and the root 60 extends from the root side 52 of the platform 50. The root 60 and the airfoil 40 extend from the platform 50 in opposite directions. The airfoil 40 has an outer wall including a pressure side 46, also called pressure surface, and a suction side 48, also called suction surface. The pressure side 46 and the suction side 48 are joined together along an upstream leading edge 42 and a downstream trailing edge 44, as depicted in FIG. 1. The root 60 includes a surface of the root 60, wherein a part of the surface of the root 60 is oriented in direction to the pressure side 46 and another part of the surface is oriented in direction to the suction side 48.

A cavity 90 is at least partially defined and enclosed by the root side 52 of the platform 50 and the root 60 of the turbomachine part 2 i.e. the part of the surface of the root 60 oriented in direction to the pressure side 46 or the another part of the surface of the root 60 oriented in direction to the suction side 48. The cavity 90 may be, but not limited to, a shank cavity present in a shank region of a turbine bucket, or the cavity 90 present beneath platform 50, especially below the pressure side 46 of the airfoil 40.

In the turbomachine part 2, the root 60 includes a main inlet 62 for receiving the cooling fluid from the cavity 90 and directing the cooling fluid into the airfoil 40. The platform cooling device 10 is adapted to be fitted in the cavity 90, i.e. the platform cooling device 10 has a form which allows that it does not dislocate from its position with respect to the cavity 90 when it is inserted in the cavity 90.

Figure 3:
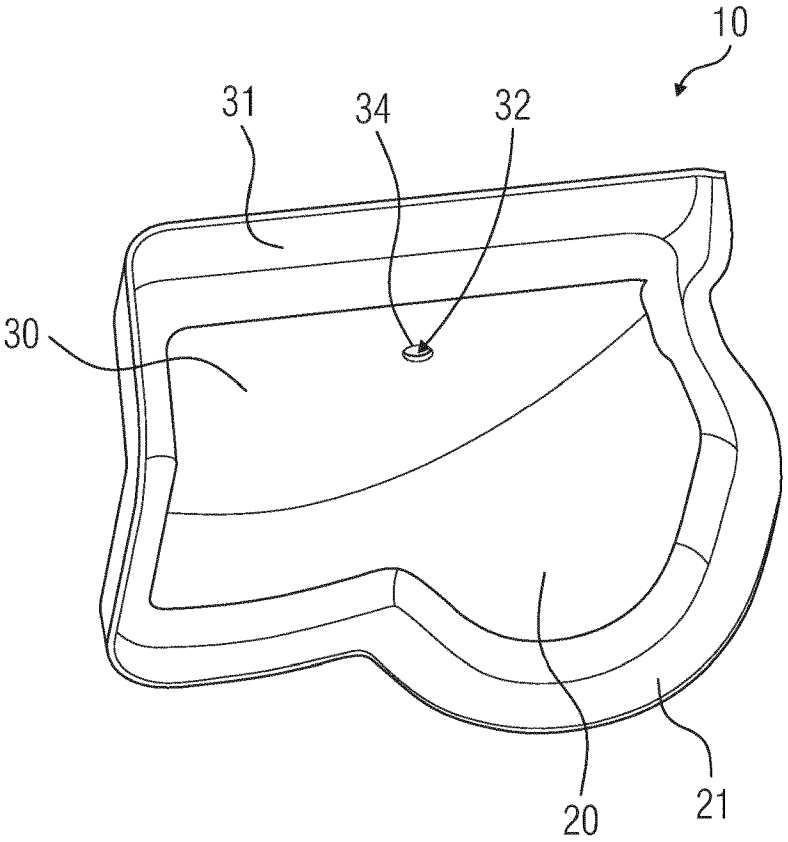
FIG. 3 is a schematic representation illustrating a bottom view of the exemplary embodiment of the platform cooling device depicted in FIG. 2.
Figure 2:
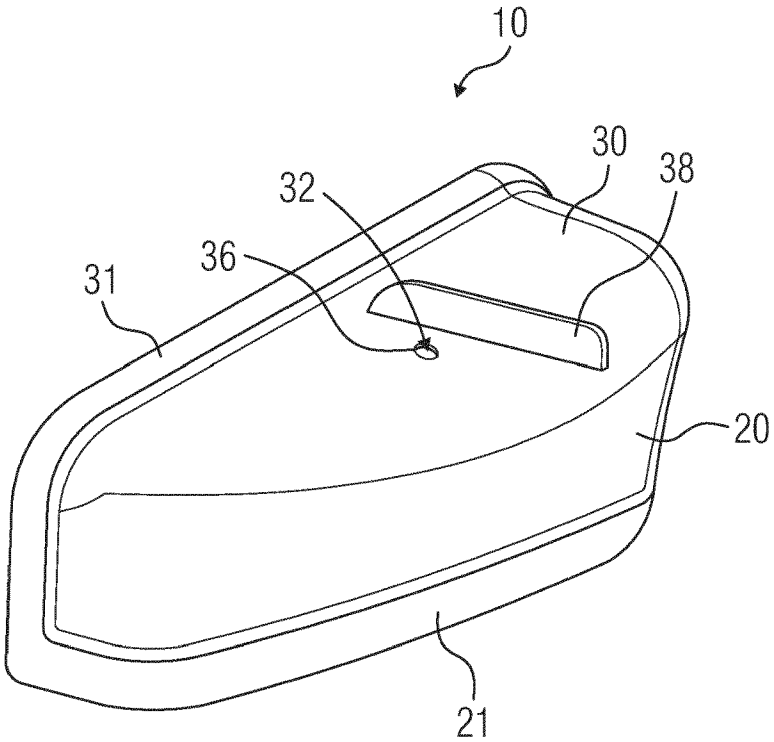
FIG. 2 is a perspective view of a schematic representation of an exemplary embodiment of a platform cooling device in accordance with aspects of the present technique.

Referring to FIGS. 2 and 3 in combination with FIG. 1, the platform cooling device 10 has been described hereinafter. FIG. 2 is a perspective view of a schematic representation of an exemplary embodiment of the platform cooling device 10 for directing a cooling fluid (not shown) onto the root side 52 (see FIG. 1) of the platform 50 (see FIG. 1) of the turbomachine part 2 (see FIG. 1), in accordance with aspects of the present technique. FIG. 3 is a schematic representation illustrating a bottom view of the exemplary embodiment of the platform cooling device 10 depicted in FIG. 2.

The platform cooling device 10 includes a first segment 20 and a second segment 30. The first segment 20 is to be positioned at the root 60 of the turbomachine part 2, i.e. at the part of the surface or the another part of the surface of the root 60. The second segment 30 is to be positioned at the root side 52 of the platform 50 of the turbomachine part 2.

The second segment 30 is arranged at an angle to the first segment 20. It may be noted that the angle between the first segment 20 and the second segment 30 may be from about 70 degrees to about 120 degrees. However, in the presently contemplated configuration as depicted in FIG. 2 the first segment 20 and the second segment 30 are perpendicular to each other.

The second segment 30 includes at least one impingement channel 32. The impingement channel 32 is a passage or pathway extending through the second segment 30 and open at both ends. The impingement channel 32 includes an inlet 34 (see FIG. 3) for receiving at least a part of the cooling fluid from the cavity 90 when the platform cooling device 10 is fitted in the cavity 90. The impingement channel 32 further includes an outlet 36 (see FIG. 2) for releasing the received cooling fluid onto the root side 52 of the platform 50. When the platform cooling device 10 is fitted in the cavity 90, the first segment 20 and the second segment 30 define a path for the cooling fluid from the cavity 90 via the impingement channel 32 to the main inlet 62. Thus the cooling fluid, when present, after cooling the root side 52 of the platform 50 enters the main inlet 62 of the root 60 of the turbomachine part 2 and proceeds to the inside of the airfoil 40 of the turbomachine part 2. This is further explained later with reference to FIG. 7.

The platform cooling device 10 further includes a rib 38 positioned on the second segment 30 such that that when the platform cooling device 10 is fitted in the cavity 90, a gap (not shown in FIGS. 1,2,3) is formed between the root side 52 of the platform 50 and the outlet 36 of the impingement channel 32.

The platform cooling device 10 includes a first protrusion 21 at the first segment 20 and a second protrusion 31 at the second segment 30. The first protrusion 21 aids in attaching the first segment 20 of the platform cooling device 10 with the root 60 of the turbomachine part 2, and the second protrusion 31 aids in attaching the second segment 30 of the platform cooling device 10 with the root side 52 of the platform 50 of the turbomachine part 2. Both protrusions 21, 31 are oriented under an angle with respect to the corresponding segments 20, 30. When the platform cooling device 10 is fitted in the cavity 90, the first protrusion 21 and the second protrusion 31 are attached to the turbomachine part 2, thus forming a chamber (not shown in FIG. 1,2,3) between the platform cooling device 10 and the turbomachine part 2 for directing the cooling fluid from the impingement channel 32 to the main inlet 62. Moreover, the first protrusion 21 and the second protrusion 31 together provide a stable attachment of the platform cooling device 10 with the turbomachine part 2, and thus the platform cooling device 10 does not dislocate from its position with respect to the cavity 90 when the platform cooling device 10 is fitted in the cavity 90 and the turbomachine is operated or moved.

Figure 5:
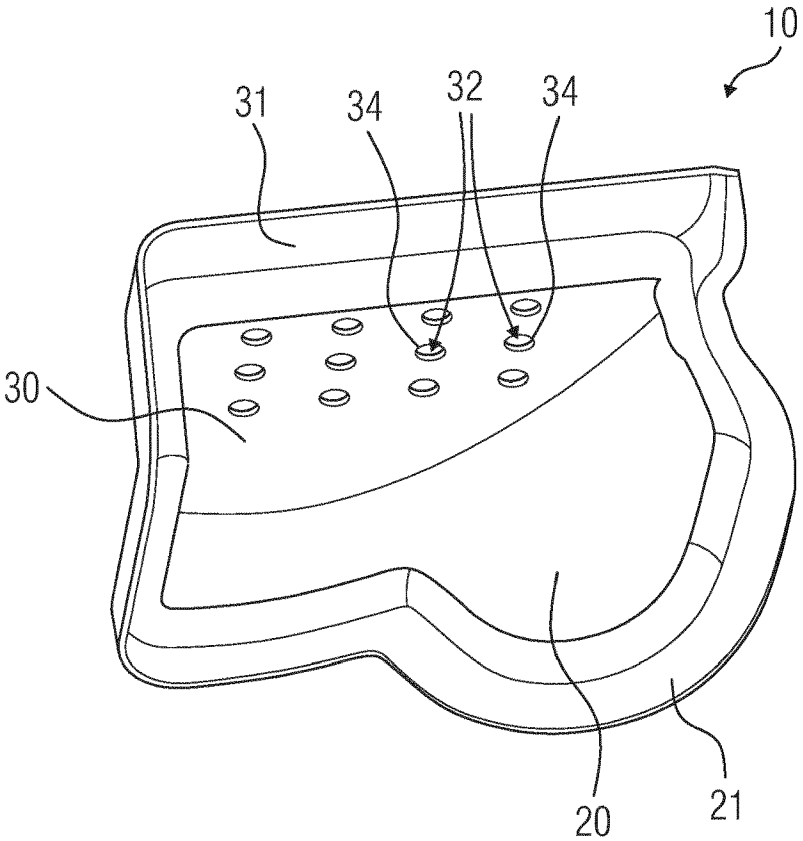
FIG. 5 is a schematic representation illustrating a bottom view of the exemplary embodiment of the platform cooling device depicted in FIG. 4.
Figure 4:
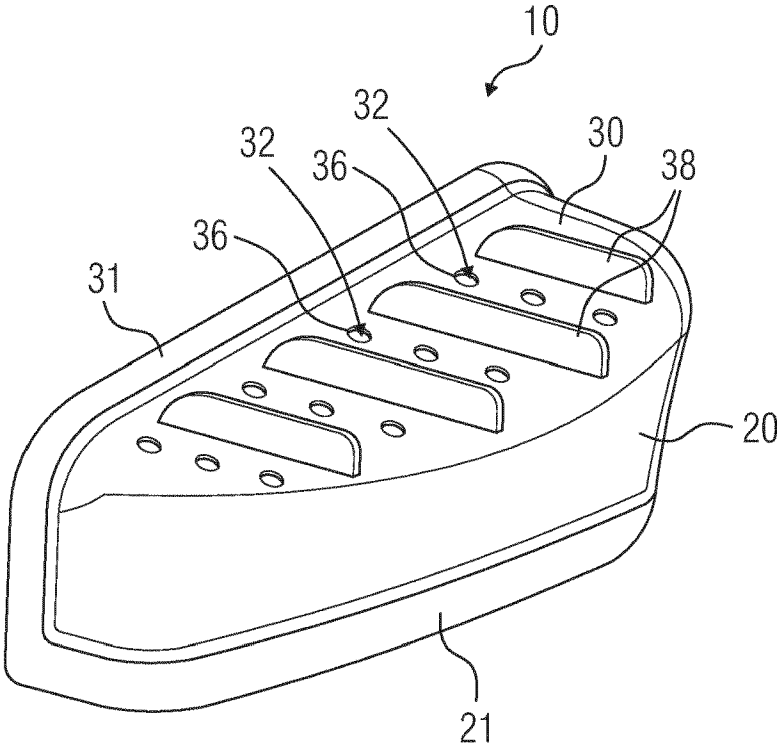
FIG. 4 is a perspective view of a schematic representation of another exemplary embodiment of the platform cooling device.

Referring now to FIG. 4 that schematically represents another exemplary embodiment of the platform cooling device 10, in combination with FIG. 5 that schematically represents a bottom view of the exemplary embodiment of the platform cooling device 10 depicted in FIG. 4. In this exemplary embodiment of the platform cooling device 10, the second segment 30 includes a plurality of ribs 38. The ribs 38 are oriented substantially parallel to each other. As a result of the plurality of ribs 38, when the platform cooling device 10 is fitted in the cavity 90 on the root side 52 of the platform 50, a gap (not shown in FIGS. 4,5) is formed between the root side 52 of the platform 50 and the outlet 36 of the impingement channel 32.

Furthermore, in the exemplary embodiment of the platform cooling device 10 as depicted in FIGS. 4 and 5, the second segment 30 includes a plurality of impingement channels 32. Each of the plurality of impingement channels 32 has an inlet 34 (exemplarily shown for only few of the impingement channels 32) for receiving at least a part of the cooling fluid from the cavity 90 and an outlet 36 (exemplarily shown for only few of the impingement channels 32) for releasing the received cooling fluid onto the root side 52 of the platform 50. The impingement channels 32 are arranged in an array. The array may be a one dimensional array meaning all the impingement channels 32 are arranged in a single file. Alternatively, the array may be a two dimensional array meaning all the impingement channels 32 are arranged in rows and columns.

Figure 6:
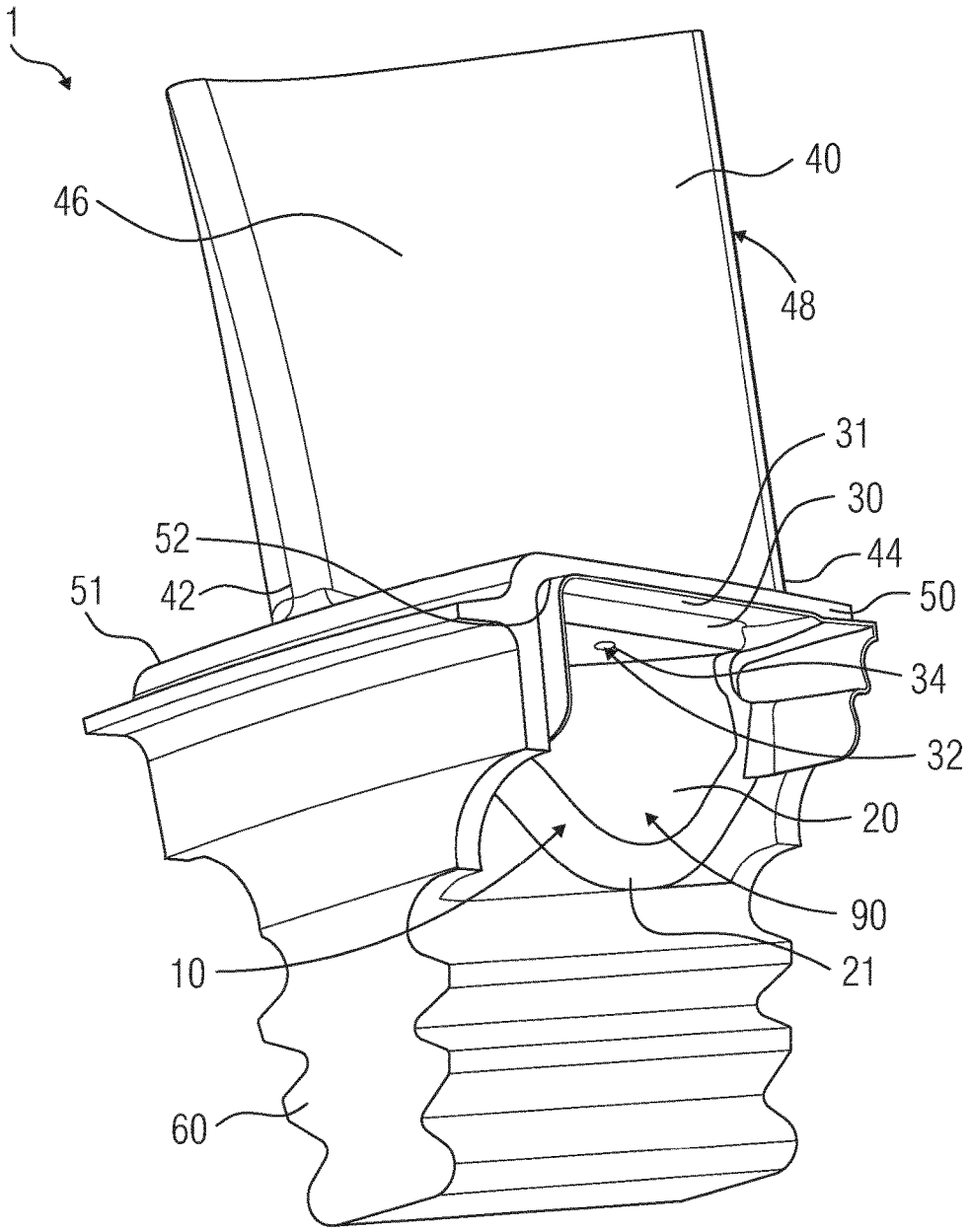
FIG. 6 is a perspective view of a schematic representation of an exemplary embodiment of a turbomachine component, in accordance with aspects of the present technique.
Figure 7:
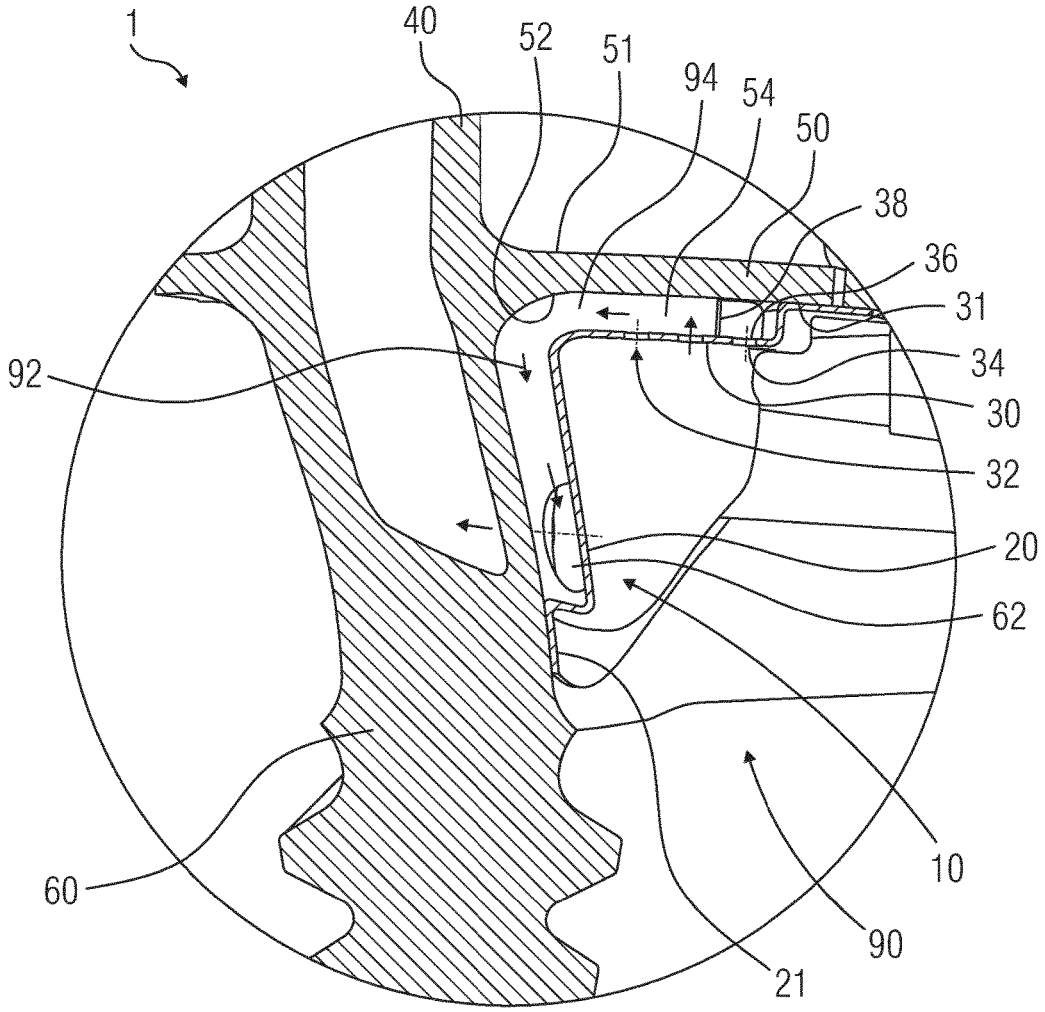
FIG. 7 is a cross-sectional view of the root and the platform of the turbomachine component including the platform cooling device of FIG. 2, in accordance with aspects of the present technique.

Referring to FIG. 6 in combination with FIG. 7, FIG. 6 is a perspective view of a schematic representation of an exemplary embodiment of a turbomachine component 1 including the platform cooling device 10, in accordance with aspects of the present technique. FIG. 7 is a cross-sectional view of a part of the turbomachine component 1 depicting the platform cooling device 10 along with adjoining parts in the turbomachine component 1, in accordance with aspects of the present technique.

The turbomachine component 1 is basically the turbomachine part 2 as described in FIG. 1, fitted with the platform cooling device 10 as described in FIGS. 2,3,4 and 5. Thus the turbomachine component 1 includes the airfoil 40, the platform 50, and the root 60. The platform 50 has the airfoil side 51 from which the airfoil 40 extends, and the root side 52 from which the root 60 extends. The root 60 and the airfoil 40 extend in opposite directions. The cavity 90 is at least partially defined by the root 60 of the turbomachine component 1, and the root side 52 of the platform 50. The root 60 further includes the main inlet 62 (not visible in FIG. 6). The turbomachine component 1 may be a blade or a vane.

As clearly depicted in FIG. 7, the platform cooling device 10 is fitted in the cavity 90 by positioning the first segment 20 at the root 60 by attaching the first protrusion 21 to the root 60, and by positioning the second segment 30 at the root side 52 by attaching the second protrusion 31 to the root side 52. The first protrusion 21 and the second protrusion 31 are attached by brazing or welding to the root 60 and the root side 52 of the platform 50, respectively. A chamber 94 is formed between the platform cooling device 10, the root side 52 of the platform 50, and the root 60 of the turbomachine component 1. The chamber 94 directs the cooling fluid from the outlet 36 of the impingement channel 32 to the main inlet 62. The first segment 20 and the second segment 30 define a path represented by arrow marks numbered as 92 for the cooling fluid to flow from the cavity 90 via the impingement channel 32 to the main inlet 62.

The rib 38 of the second segment 30 is positioned at the root side 52 of the platform 50 such that a gap 54 is formed between the root side 52 and the outlet 36 of the impingement channel 32. As previously mentioned the platform cooling device may have more than one rib 38 that extend towards the root side 52 and are arranged substantially parallel to each other. Moreover, the platform cooling device 10 may also include more than one impingement channel 32 that are arranged in a one dimensional array or two dimensional array.

Figure 8:
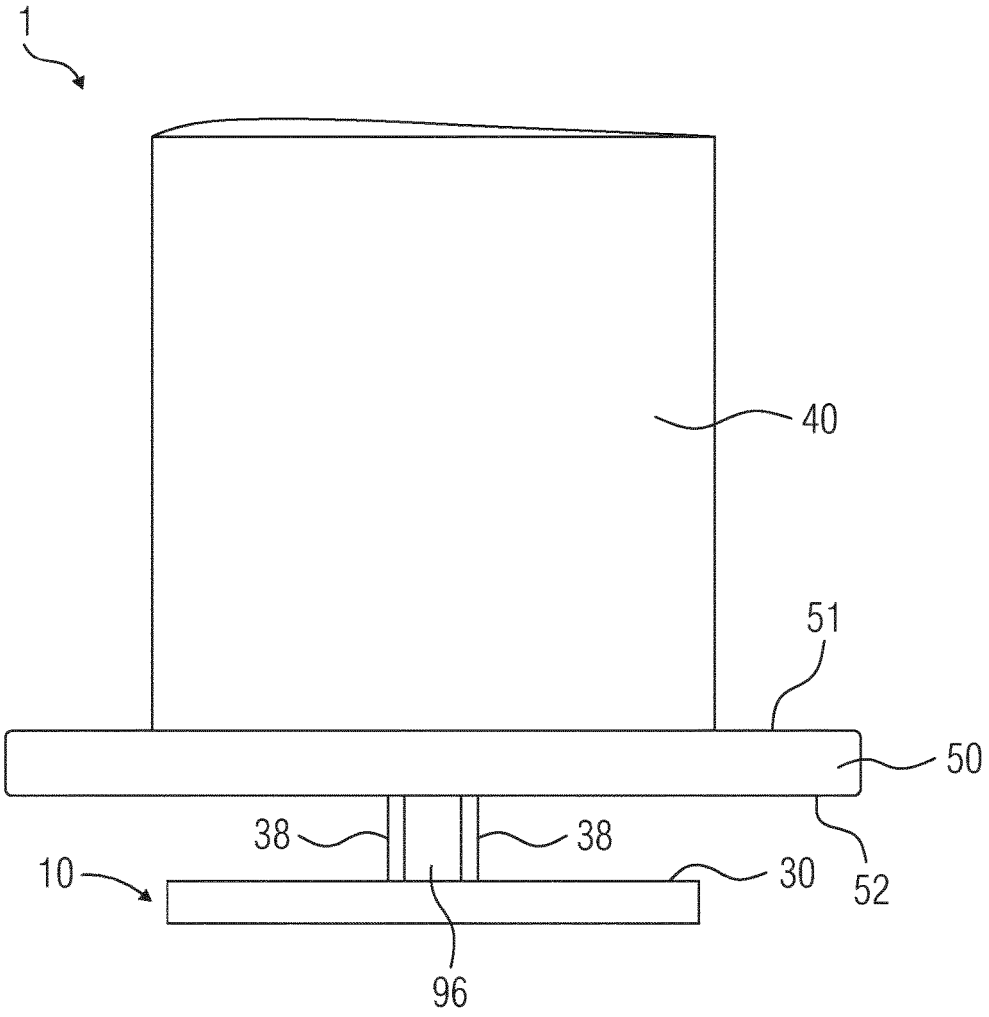
FIG. 8 is a schematic representation of the turbomachine component depicting a cooling channel.

Referring to FIG. 8, a schematic representation of the turbomachine component 1 is shown depicting a cooling channel 96. The cooling channel 96 is formed by the root side 52 of the platform 50 and a part of the second segment 30 having at least two ribs 38. The cooling channel 96 is present in the chamber 94 and directs the cooling fluid towards the main inlet 62 (not shown in FIG. 8) along the root side 52 of the platform 50.

Figure 9:
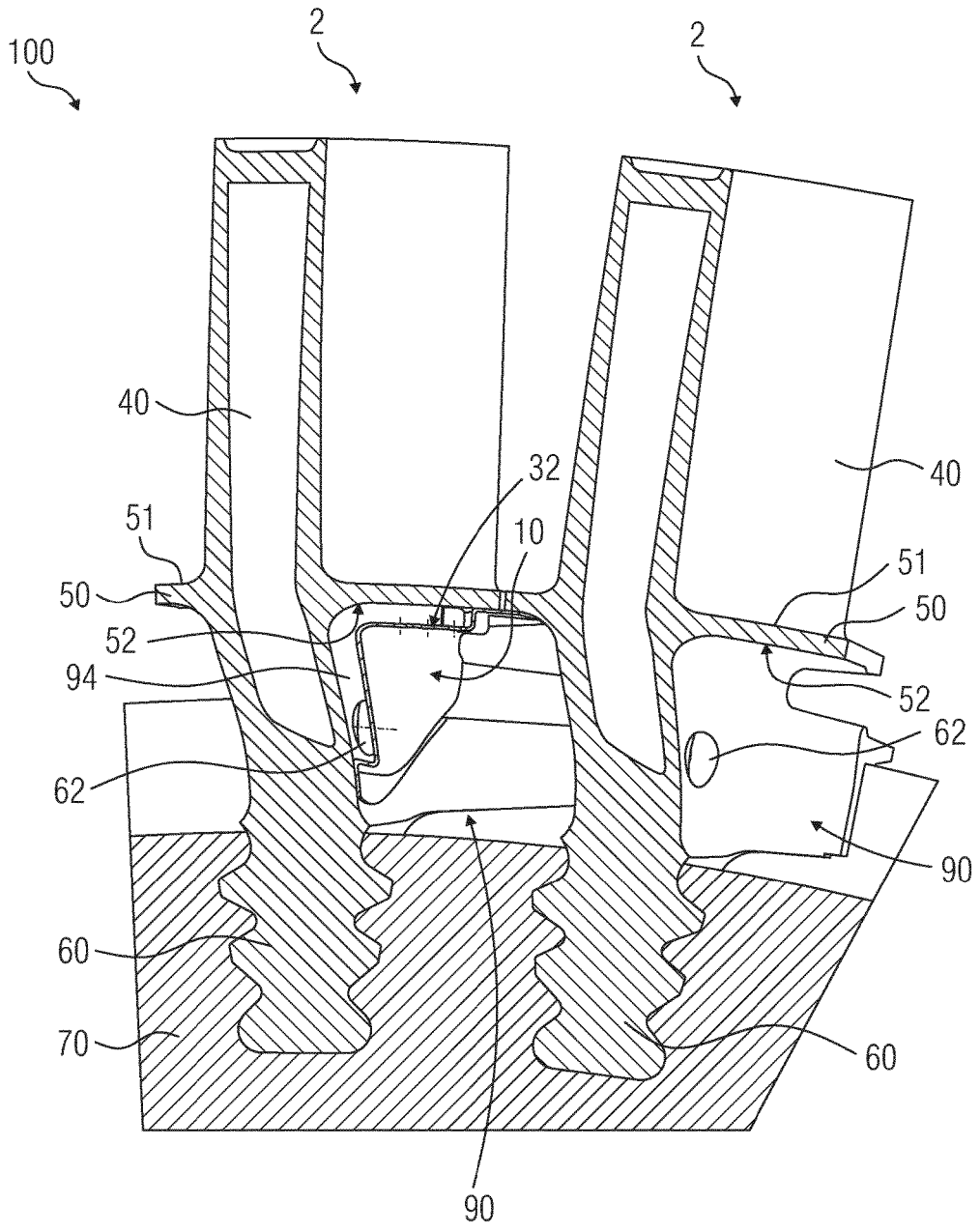
FIG. 9 is a schematic representation of an exemplary embodiment of a turbomachine assembly, in accordance with aspects of the present technique.

Referring to FIG. 9, a schematic representation of an exemplary embodiment of a turbomachine assembly 100 is shown, in accordance with aspects of the present technique. The turbomachine assembly 100 includes at least two turbomachine parts 2 positioned adjacent to each other in a circumferential direction, and at least one platform cooling device 10 fitted in between the at least two turbomachine parts 2. The turbomachine parts 2 are same as the turbomachine part 2 described in reference to FIG. 1. The platform cooling device 10 is same as described in FIGS. 2,3,4 and 5. The platform cooling device 10 is fitted in the cavity 90 of one of the turbomachine parts 2 in the same way as described in reference to FIGS. 6,7 and 8. The turbomachine parts 2 may be mounted on a rotor disc 70.

The cavity 90 in which the platform cooling device 10 is fitted is a part of an extended cavity (not shown) in the turbomachine assembly 100. The extended cavity is defined and enclosed by the root sides 52 of the platforms 50 of both the turbomachine parts 2, the roots 60 of both the turbomachine parts 2, and optionally by one or more seal strips (not shown) extending between the at least two turbomachine parts 2, and/or one or more sealing plates (not shown) extending between the at least two turbomachine parts 2. Additionally, an outer radial surface (not shown) of the rotor disc 70 may participate in defining and enclosing the extended cavity.

According to an embodiment of the invention the platform cooling device 10 is a separate part or component that is adapted to be connected to any turbomachine part 2 such that cooling fluid can be directed to the cooled surfaces of the turbomachine part 2. Particularly the platform cooling device 10 is formed such that a cooling fluid is directed onto a root side 52 of a platform 50 of the turbomachine part 2. Such a turbomachine part 2 includes an airfoil 40, the platform 50, and a root 60 having a main inlet 62 for receiving the cooling fluid from a cavity 90 and directing the cooling fluid into the airfoil 40, the cavity 90 at least partially defined by the root 60 of the turbomachine part 2 and the root side 52 of the platform 50. This is essentially a standard turbomachine part as already known. Thus, particularly the turbomachine part 2 is adapted to allow platform cooling of a turbine vane or a turbine blade. Specifically, the platform cooling device 10 is adapted to be fitted in the cavity 90.

To achieve this, the platform cooling device 10 includes a first segment 20 to be positioned at the root 60 of the turbomachine part 2 and a second segment 30 arranged at an angle to the first segment 20. The second segment 30 is to be positioned at the root side 52 of the platform 50, wherein the second segment 30 includes at least one impingement channel 32 including an inlet 34 for receiving at least a part of the cooling fluid from the cavity 90 and an outlet 36 for releasing the received cooling fluid onto the root side 52 of the platform 50, such that the first segment 20 and the second segment 30 define a path 92 for the cooling fluid from the cavity 90 via the impingement channel 32 to the main inlet 62.

Thus, the platform cooling device 10 is configured to follow the form and/or features of the to be cooled turbomachine part 2.

While the present technique has been described in detail with reference to certain embodiments, it should be appreciated that the present technique is not limited to those precise embodiments. Rather, in view of the present disclosure which describes exemplary modes for practicing embodiments of the invention, many modifications and variations would present themselves, to those skilled in the art without departing from the scope and spirit of this invention. The scope of the invention is, therefore, indicated by the following claims rather than by the foregoing description. All changes, modifications, and variations coming within the meaning and range of equivalency of the claims are to be considered within their scope.

The invention claimed is:

1. A platform cooling device for directing a cooling fluid onto a root side of a platform of a turbomachine part, the turbomachine part comprising an airfoil, the platform, and a root comprising a main inlet for receiving the cooling fluid from a cavity and directing the cooling fluid into the airfoil, the cavity at least partially defined by the root of the turbomachine part and the root side of the platform, wherein the platform cooling device is adapted to be fitted in the cavity, the platform cooling device comprising:

a first segment to be positioned at the root of the turbomachine part, a second segment arranged at an angle to the first segment, the second segment to be positioned at the root side of the platform, wherein the second segment comprises at least one impingement channel comprising an inlet for receiving at least a part of the cooling fluid from the cavity and an outlet for releasing the at least a part of the cooling fluid onto the root side of the platform, such that the first segment and the second segment define a path for the cooling fluid from the cavity via the at least one impingement channel to the main inlet, and a first protrusion at the first segment for attaching to the root of the turbomachine part and a second protrusion at the second segment for attaching to the root side of the platform such that a chamber is formed between the platform cooling device and the turbomachine part for directing the cooling fluid from the at least one impingement channel to the main inlet.

2. The platform cooling device according to claim 1, wherein the second segment comprises at least one rib such that, when the platform cooling device is fitted in the cavity, on the root side of the platform a gap is formed between the root side of the platform and the outlet of the at least one impingement channel.

3. The platform cooling device according to claim 1, wherein the second segment comprises a plurality of ribs oriented parallel to each other such that, when the platform cooling device is fitted in the cavity, on the root side of the platform a gap is formed between the root side of the platform and the outlet of the at least one impingement channel.

4. The platform cooling device according to claim 1, wherein the at least one impingement channel comprises a plurality of impingement channels, each impingement channel of the plurality of impingement channels comprising a respective inlet for receiving a respective portion of the at least a part of the cooling fluid from the cavity and a respective outlet for releasing the respective portion of the at least a part of the cooling fluid onto the root side of the platform, wherein the plurality of impingement channels are arranged in an array.

5. A turbomachine component comprising:

a platform comprising an airfoil side and a root side, an airfoil extending from the airfoil side of the platform, a root extending from the root side of the platform, the root and the airfoil extending in opposite directions, wherein the root comprises a main inlet for receiving a cooling fluid from a cavity on the root side of the platform and directing the cooling fluid into the airfoil, the cavity at least partially defined by the root of the turbomachine component and the root side of the platform, and a platform cooling device fitted in the cavity for directing the cooling fluid from the cavity onto the root side of the platform, the platform cooling device comprising:

a first segment positioned at the root of the turbomachine component, and a second segment arranged at an angle to the first segment, the second segment positioned at the root side of the platform, wherein the second segment comprises at least one impingement channel comprising an inlet for receiving at least a part of the cooling fluid from the cavity and an outlet for releasing the at least a part of the cooling fluid onto the root side of the platform, such that the first segment and the second segment define a path for the cooling fluid from the cavity via the at least one impingement channel to the main inlet, wherein the first segment comprises a first protrusion attached to the root of the turbomachine component and the second segment comprises a second protrusion attached to the root side of the platform such that a chamber is formed between the platform cooling device, the root side of the platform, and the root of the turbomachine component for directing the cooling fluid from the at least one impingement channel to the main inlet.

6. The turbomachine component according to claim 5, wherein the second segment comprises at least one rib extending towards the root side of the platform such that a gap is formed between the root side of the platform and the outlet of the at least one impingement channel.

7. The turbomachine component according to claim 5, wherein the second segment comprises a plurality of ribs extending towards the root side of the platform such that a gap is formed between the root side of the platform and the outlet of the at least one impingement channel and wherein the plurality of ribs are oriented parallel to each other.

8. The turbomachine component according to claim 7, further comprising a cooling channel formed by the root side of the platform and a part of the second segment comprising at least two ribs of the plurality of ribs, wherein the cooling channel directs the cooling fluid towards the main inlet.

9. The turbomachine component according to claim 5, wherein the first protrusion is attached to the root of the turbomachine component and the second protrusion is attached to the root side of the platform through brazing.

10. The turbomachine component according to claim 5, wherein the first protrusion is attached to the root of the turbomachine component and the second protrusion is attached to the root side of the platform through welding.

11. The turbomachine component according to claim 5, wherein the at least one impingement channel comprises a plurality of impingement channels, each impingement channel of the plurality of impingement channels comprising a respective inlet for receiving a respective portion of the at least a part of the cooling fluid from the cavity and a respective outlet for releasing the respective portion of the at least a part of the cooling fluid onto the root side of the platform, wherein the plurality of impingement channels are arranged in an array.

12. The turbomachine component according to claim 5, wherein the turbomachine component is a blade of a turbine.

13. The turbomachine component according to claim 5, wherein the turbomachine component is a vane of a turbine.

* * * * *